US011661254B1

(12) United States Patent
Storms, Jr. et al.

(10) Patent No.: US 11,661,254 B1
(45) Date of Patent: May 30, 2023

(54) INTEGRAL ACCESSORY ATTACHMENT INTERFACE

(71) Applicant: Sentry Solutions Products Group LLC, Virginia Beach, VA (US)

(72) Inventors: Frederick W. Storms, Jr., Virginia Beach, VA (US); Eric M. Yeates, Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

(21) Appl. No.: 17/397,715

(22) Filed: Aug. 9, 2021

Related U.S. Application Data

(60) Provisional application No. 63/062,483, filed on Aug. 7, 2020.

(51) Int. Cl.
*B65D 63/10* (2006.01)
*A44B 11/20* (2006.01)
*A45F 5/02* (2006.01)

(52) U.S. Cl.
CPC ..... *B65D 63/1027* (2013.01); *A44B 11/20* (2013.01); *A45F 5/021* (2013.01)

(58) Field of Classification Search
CPC ..... B65D 63/1027; A44B 11/20; A45F 5/021
See application file for complete search history.

(56) References Cited

U.S. PATENT DOCUMENTS 4,934,573 A 6/1990 Jaeger
6,840,420 B1 * 1/2005 Hudson ..... A44C 3/001 224/675

(Continued)

FOREIGN PATENT DOCUMENTS

EP 1260151 7/2004
GB 2491624 12/2012

(Continued)

OTHER PUBLICATIONS 5.11 Tactical Introduces Hexgrid Molle Compatible Attachment System; https://www.thefirearmblog.com/blog/2016/01/28/5-11-tactical-introduces-hexgrid-molle-compatible-attachment-system/; Jan. 28, 2016.

(Continued)

*Primary Examiner* — David M Upchurch
(74) *Attorney, Agent, or Firm* — Shaddock Law Group, PC

(57) ABSTRACT

An integral accessory attachment interface having at least some of an attachment interface portion having a plurality of attachment slots provided therethrough; and at least one accessory attachment element extending as an integral extension of a portion of said attachment interface portion, wherein at least a portion of the accessory attachment element is folded over, proximate a junction between the attachment interface portion and the accessory attachment element, wherein at least a portion of the accessory attachment element is urged through an aligned attachment slot formed proximate the junction between the attachment interface portion the accessory attachment element, to extend through the attachment slot, from a front side of the attachment interface portion, and wherein the accessory attachment element is at least partially attached or coupled to a portion of the attachment interface portion to assist in maintaining the accessory attachment element through the aligned attachment slot.

20 Claims, 8 Drawing Sheets

(56) References Cited

U.S. PATENT DOCUMENTS

| | | | | |
|---|---|---|---|---|
| 7,963,427 | B2 * | 6/2011 | Calkin | A41D 13/0012 224/675 |
| D677,433 | S | 3/2013 | Swan et al. | |
| 9,144,255 | B1 | 9/2015 | Perciballi | |
| 9,173,436 | B2 | 11/2015 | Crye | |
| 9,521,897 | B2 * | 12/2016 | Thompson | A45F 5/02 |
| 9,565,922 | B2 * | 2/2017 | Cole | A45F 5/02 |
| 9,664,481 | B2 | 5/2017 | Alcantra et al. | |
| 9,723,909 | B2 | 8/2017 | Alcantra et al. | |
| 10,070,714 | B2 | 9/2018 | Alcantra et al. | |
| 10,264,874 | B2 * | 4/2019 | Becker | A45F 3/14 |
| 10,944,140 | B2 * | 3/2021 | Thiel | H01M 50/242 |
| 11,299,101 | B2 * | 4/2022 | Busse | B60R 7/043 |
| 2005/0284903 | A1 | 12/2005 | Knapp | |
| 2010/0276320 | A1 | 11/2010 | Kim | |
| 2012/0180184 | A1 | 7/2012 | Crye | |
| 2012/0280008 | A1 | 11/2012 | Rossetti et al. | |
| 2013/0098961 | A1 | 4/2013 | Strum | |
| 2015/0189977 | A1 | 7/2015 | Thompson | |
| 2015/0335140 | A1 * | 11/2015 | Cole | A45F 3/00 24/3.1 |
| 2016/0040958 | A1 | 2/2016 | Mcantra et al. | |
| 2016/0191110 | A1 | 6/2016 | Brecher et al. | |
| 2017/0320286 | A1 | 11/2017 | Carlson | |
| 2021/0019008 | A1 | 1/2021 | Grundy et al. | |

FOREIGN PATENT DOCUMENTS

| | | |
|---|---|---|
| WO | 2016022838 | 2/2016 |
| WO | WO2016201363 | 12/2016 |

OTHER PUBLICATIONS https://www.facebook.com/HighSpeedGear, Jun. 12, 2018.
https://www.facebook.com/HighSpeedGear, Jun. 26, 2018.

* cited by examiner

INTEGRAL ACCESSORY ATTACHMENT INTERFACE

CROSS-REFERENCE TO RELATED APPLICATIONS

This patent application claims the benefit of U.S. Patent Application Ser. No. 63/062,483, filed Aug. 7, 2020, the disclosure of which is incorporated herein by reference in its entirety.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the present disclosure relates to an integral accessory attachment interface.

2. Description of Related Art

It is advantageous be able to configure and/or reconfigure various pouches, pockets, holsters, holders, and other accessories on items such as, for example, articles of clothing, vests, plate carriers, backpacks, packs, platforms, and other carriers.

It is generally known to removably attach such items using a MOLLE or other similar attachment system. The term MOLLE (Modular Lightweight Load-carrying Equipment) is used to generically describe load bearing systems and subsystems that utilize corresponding rows of interwoven webbing for modular pouch, pocket, and accessory attachment interface.

The MOLLE system is a modular system that incorporates the use of corresponding rows of webbing stitched onto a piece of equipment, such as a vest, and the various MOLLE compatible pouches, pockets, and accessories, each accessory having mating rows of stitched webbing. MOLLE compatible pouches, pockets, and accessories of various utility can then be attached or coupled wherever MOLLE webbing exists on the equipment.

The terms "MOLLE-compatible" or "MOLLE" system are not used to describe a specific system, but to generically describe accessory attachment interface systems that utilize interwoven PALS (Pouch Attachment Ladder System) webbing for modular accessory attachment interface portions.

An exemplary MOLLE compatible carrier portion includes a plurality of substantially parallel rows of spaced apart, horizontal carrier webbing elements. Each of the carrier webbing elements is secured to a backing or carrier material, by vertical stitching, at spaced apart locations, such that a tunnel segment is formed between the carrier material and the carrier webbing elements between each secured location of the carrier webbing elements. Each of the tunnel segments is formed substantially perpendicular to a longitudinal axis or direction of the carrier webbing elements.

The MOLLE compatible carrier portion, or MOLLE system grid, typically consists of horizontal rows of 1 inch (2.5 cm) webbing, spaced 1 inch apart, and attached or coupled to the carrier material at 1.5 inch (3.8 cm) intervals.

An exemplary accessory includes a plurality of substantially parallel, spaced apart accessory webbing elements. The accessory webbing elements are spaced apart so as to correspond to the spaces between the spaced apart carrier webbing elements. The accessory webbing elements are secured to the accessory at spaced apart locations, such that an accessory tunnel segment is formed between the accessory and the accessory webbing element between each secured location of the accessory webbing element. Each of the accessory tunnel segments is formed substantially perpendicular to a longitudinal direction of the accessory webbing elements.

When the accessory is placed adjacent the carrier material such that the accessory webbing elements are within the spaces between the spaced apart carrier webbing elements (and the carrier webbing elements are within the spaces between the spaced apart accessory webbing elements) and corresponding tunnel segments and accessory tunnel segments are aligned, a strap or coupling element may be interwoven between the aligned tunnel segments and accessory tunnel segments (alternating between horizontal carrier webbing element portions on the host or carrier material and horizontal webbing portions on the accessory) to removably attach the accessory to the carrier material.

Thus, through the use of a MOLLE or MOLLE-type system, an accessory may be mounted to a variety of carrier materials. Likewise, if a particular carrier material includes a MOLLE compatible system, a variety of accessories may be interchangeably mounted to the platform to accommodate a variety of desired configurations.

MOLLE compatible systems allow, for example, various pouch arrangements to be specifically tailored to a desired configuration and then reconfigured, if desired. Various desired pouches, pockets, and accessories can be added and undesired or unnecessary pouches, pockets, or accessories can be removed.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

Brief Summary of the Present Disclosure

However, the typical "MOLLE-compatible" or "MOLLE" system arrangement has various shortcomings. For example, known "MOLLE-compatible" or "MOLLE" systems typically utilize strap or coupling elements that are either separate portions of material sewn to the accessory or separate, discrete portions of plastic or other material. If sewn, the strap or coupling elements can be separated from the accessory. If the strap or coupling elements comprise separate portions of plastic other material, the strap or coupling elements can be lost or misplaced. In either case, the bulk of known strap or coupling elements typically creates a significant gap between the accessory and the carrier material, when interwoven between the accessory in the carrier material.

In order to solve these and other shortcomings of known "MOLLE-compatible" or "MOLLE" system strap or coupling elements and/or other attachment interfaces and to provide certain advantages over known "MOLLE-compatible" or "MOLLE" system strap or coupling elements and/or other attachment interfaces, the integral accessory attachment interface of the present disclosure provides an attachment interface panel including at least some of an attachment interface portion, wherein a plurality of attachment slots are provided through at least a portion of said attachment interface portion; and at least one accessory attachment element extending as an integral extension of a portion of said attachment interface portion, wherein at least a portion of the accessory attachment element is folded over, proximate a junction between the attachment interface portion and the accessory attachment element, toward a rear side of the attachment interface portion, wherein at least a portion of the accessory attachment element is urged through an aligned attachment slot formed proximate the junction between the attachment interface portion the accessory attachment element, to extend through the attachment slot, from a front side of the attachment interface portion, and wherein the accessory attachment element is at least partially attached or coupled to a portion of the attachment interface portion to assist in maintaining the accessory attachment element through the aligned attachment slot.

In certain exemplary, nonlimiting embodiments, the integral accessory attachment interface of the present disclosure provides an attachment interface portion, wherein a plurality of attachment slots are provided through at least a portion of the attachment interface portion; and one or more accessory attachment elements extending as an integral extension of a portion of the attachment interface portion, wherein at least a portion of each accessory attachment element is folded over, proximate a junction between the attachment interface portion and the accessory attachment element, toward a rear side of the attachment interface portion, wherein at least a portion of each accessory attachment element is urged through an aligned attachment slot formed proximate the junction between the attachment interface portion and the accessory attachment element, to extend through the attachment slot, from a front side of the attachment interface portion, and wherein each of the accessory attachment elements is at least partially attached or coupled to a portion of the attachment interface portion to assist in maintaining the accessory attachment element through the aligned attachment slot.

In certain exemplary, nonlimiting embodiments, the integral accessory attachment interface is formed of a single, integral portion of material.

In certain exemplary, nonlimiting embodiments, the integral accessory attachment interface is formed of a one-piece article.

In certain exemplary, nonlimiting embodiments, the integral accessory attachment interface is formed as a unitary body.

In certain exemplary, nonlimiting embodiments, each of the accessory attachment elements is at least partially attached or coupled to a portion of the attachment interface portion, via stitching, to assist in maintaining the accessory attachment element through the aligned attachment slot.

In certain exemplary, nonlimiting embodiments, one or more vertical tunnel slots are formed through at least a portion of the attachment interface portion.

In certain exemplary, nonlimiting embodiments, one or more horizontal tunnel slots are formed through at least a portion of the attachment interface portion.

In certain exemplary, nonlimiting embodiments, the integral accessory attachment interface of the present disclosure provides an attachment interface portion, wherein a plurality of attachment slots are provided through at least a portion of the attachment interface portion; and at least one accessory attachment element extending as an integral extension of a portion of the attachment interface portion, wherein at least a portion of the accessory attachment element is folded over, proximate a junction between the attachment interface portion and the accessory attachment element, toward a rear side of the attachment interface portion, wherein at least a portion of the accessory attachment element is urged through an aligned attachment slot formed proximate the junction between the attachment interface portion and the accessory attachment element, to extend through the attachment slot, from a front side of the attachment interface portion, and wherein the accessory attachment element is at least partially attached or coupled to a portion of the attachment interface portion to assist in maintaining the accessory attachment element through the aligned attachment slot.

In certain exemplary, nonlimiting embodiments, the integral accessory attachment interface of the present disclosure provides an attachment interface panel having an attachment interface portion and at least one accessory attachment element, wherein a plurality of attachment slots are provided through at least a portion of the attachment interface portion, and wherein the at least one accessory attachment element extends as an integral extension of a portion of the attachment interface portion, wherein at least a portion of the accessory attachment element is urged through an aligned attachment slot formed proximate the junction between the attachment interface portion and the accessory attachment element, to extend through the attachment slot, from a front side of the attachment interface portion, and wherein the accessory attachment element is at least partially attached or coupled to a portion of the attachment interface portion to assist in maintaining the accessory attachment element through the aligned attachment slot.

Accordingly, the present disclosure separately and optionally provides an integral accessory attachment interface that allows a user to readily attach an accessory to at least a portion of a carrier or carrier material.

The present disclosure separately and optionally provides an integral accessory attachment interface that includes accessory attachment elements formed integral to a portion of the attachment interface.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
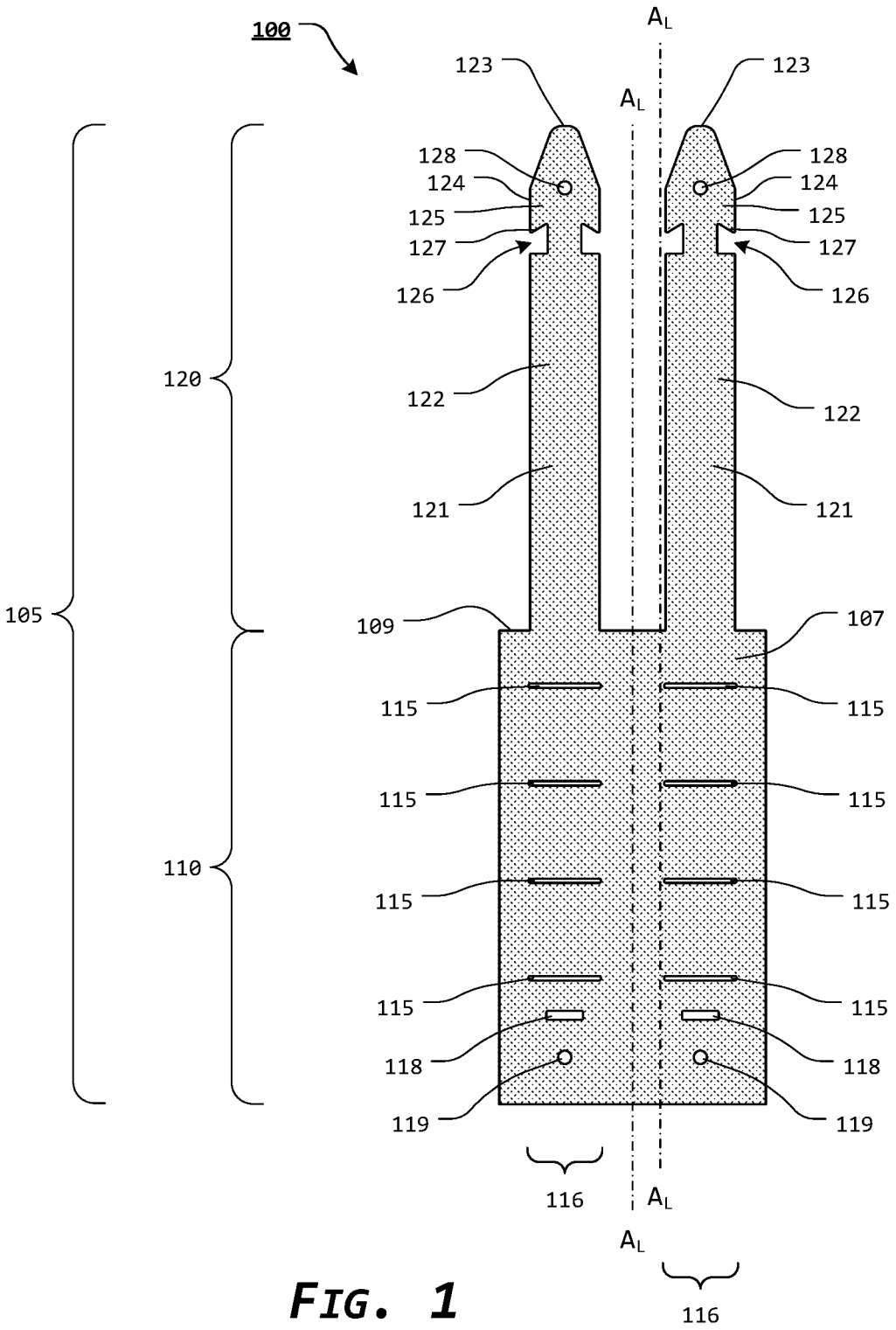
FIG. 1 illustrates a front view of certain exemplary components of an exemplary embodiment of an integral accessory attachment interface, according to the present disclosure.

For simplicity and clarification, the design factors and operating principles of the integral accessory attachment interface according to the present disclosure are explained with reference to various exemplary embodiments of an integral accessory attachment interface according to the present disclosure. The basic explanation of the design factors and operating principles of the integral accessory attachment interface is applicable for the understanding, design, and operation of the integral accessory attachment interface of the present disclosure. It should be appreciated that the integral accessory attachment interface can be adapted to many applications where an integral accessory attachment interface can be used.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "top" and "bottom", "upper" and "lower", and "horizontal" and "vertical" are used to arbitrarily distinguish between the exemplary embodiments and/or elements such terms describe. Thus, these terms are not necessarily intended to indicate temporal or other prioritization of such exemplary embodiments and/or elements.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

Furthermore, the terms "front", "rear", "right", "left", "upper", and "lower", as used in reference to the attachment interface and the attachment interface portion, are used for basic explanation and understanding of the operation of the presently disclosed systems, methods, and/or apparatuses and are to be seen as a naming convention used to help differentiate between certain of the components of the present disclosure and are not to be construed as limiting the systems, methods, and/or apparatuses of the present disclosure.

It should also be appreciated that the terms "integral accessory attachment interface", "attachment interface", "accessory attachment portion", "accessory interface portion", and "accessory" are used for basic explanation and understanding of the operation of the systems, methods, and apparatuses of the present disclosure. Therefore, the terms "integral accessory attachment interface", "attachment interface", "accessory attachment portion", "accessory interface portion", and "accessory" are not to be construed as limiting the systems, methods, and apparatuses of the present disclosure.

For simplicity and clarification, the integral accessory attachment interface of the present disclosure will be shown and/or described as being used in conjunction with a rear portion of an exemplary accessory pouch being utilized as an exemplary accessory. However, it should be appreciated that these are merely exemplary embodiments of the integral accessory attachment interface and are not to be construed as limiting the present disclosure. Thus, the integral accessory attachment interface of the present disclosure may be utilized in conjunction with any portion of a carrier or carrier material, object, or device.

Turning now to the appended drawing figures, FIGS. 1-9 illustrate certain elements and/or aspects of an exemplary embodiment of an integral accessory attachment interface 100, according to the present disclosure.

In certain illustrative, non-limiting embodiment(s) of the presently disclosed systems, methods, and/or apparatuses, as illustrated in FIGS. 1-7, the integral accessory attachment interface 100 comprises at least one attachment interface panel 105 having a front side 107 and an opposing rear side 109. The attachment interface panel 105 includes an attachment interface portion 110 and an accessory attachment portion 120 formed as single, integral components of the attachment interface panel 105.

Thus, the attachment interface panel 105 optionally includes an attachment interface portion 110 and an accessory attachment portion 120 formed of a one-piece article or a unitary body.

One or more accessory attachment elements 121 extend as an integral extension of a portion of the attachment interface portion 110 to form the accessory attachment portion 120. Each accessory attachment element 121 includes an extension portion 122 that extends from the attachment interface portion 110. The extension portion 122 extends to a terminating portion 125 having a terminating end. Each extension portion 122 generally extends parallel to a longitudinal axis, $A_L$, of the attachment interface panel 105. Thus, instead of being formed of a separate material or separate portion of material that is attached or coupled to the attachment interface portion 110, each accessory attachment element 121 extends as a continuation of the material used to form the attachment interface portion 110 of the attachment interface panel 105.

It should be appreciated that the attachment interface panel 105 may be formed so as to include a single accessory attachment element 121 extending from the attachment interface portion 110 and including a single column 116 of attachment slots 115 and at least one locking slot 118 and optional locking aperture 119. Alternatively, the attachment interface panel 105 may include 2 or more accessory attachment elements 121 extending from the attachment interface portion 110 and a corresponding column 116 of attachment slots 115 and at least one locking slot 118 and optional locking aperture 119 for each accessory attachment element 121.

Attachment element notches 126 are defined by recesses formed in opposing side portions of each accessory attachment element 121, between the extension portion 122 and a terminating portion 125 of each accessory attachment element 121. The attachment element notches 126 defined portions of the accessory attachment element 121 with a reduced width, when compared to Joe's and portions of the extension portion 122 and the terminating portion 125.

Each attachment element notch 126 defines a shoulder 127, proximate the terminating portion 125. In various exemplary embodiments, the shoulder 127 is optionally formed substantially perpendicular to a longitudinal axis, $A_L$, of the accessory attachment element 121. Alternatively, the shoulder 127 is optionally formed at an acute or obtuse angle relative to the longitudinal axis, $A_L$, of the accessory attachment element 121. In these exemplary embodiments, the angle of the shoulder 127 allows the terminating portion 125 to be more firmly held within a locking slot 118.

A wing portion 124 extends from the shoulder 127 of each attachment element notch 126, toward the terminating end of the accessory attachment element 121, within the terminating portion 125 of the accessory attachment element 121. In various exemplary embodiments, a width of the wing portion 124, proximate the shoulder 127, is the same or substantially the same as the width of the extension portion 122 of the accessory attachment element 121. The width of the wing portion 124 may optionally taper as the wing portion 124 extends from the shoulder 127 or proximate the shoulder 127 to the terminal end 123.

An attachment locking aperture 128 may optionally be formed through a portion of the accessory attachment element 121, proximate the terminal end 123. If included, the attachment locking aperture 128 may be utilized to further assist in securing the accessory attachment element 121 to the attachment interface portion 110 by allowing a portion of material to be positioned through the attachment locking aperture 128 and the locking aperture 119 of the attachment interface portion 110.

The attachment interface portion 110 is formed so as to include a plurality of spaced apart attachment slots 115 formed therethrough. In various exemplary embodiments, the attachment slots 115 are generally formed as slots or apertures through the attachment interface portion 110. Each attachment slot 115 is defined by one or more continuous edges.

The attachment interface portion 110 of the present disclosure is operable with as few as two attachment slots 115. Thus, the size and shape of the attachment interface portion 110 is a design choice, based upon, for example, the size and shape of the portion of attachment interface portion 110 that is desired to potentially accept attachment or coupling of accessory attachment element(s) 121.

In various exemplary embodiments, the size of each attachment slot 115 is influenced or dictated by the width of the accessory attachment element(s) 121. For example, if an accessory attachment element 121 has a width of approximately 1 inch, the width of the attachment slots 115 may optionally be slightly greater than approximately 1 inch, so as to allow the accessory attachment element(s) 121 to be appropriately positioned through the attachment slots 115. It should be appreciated that the size and shape of each of the attachment slots 115 is a design choice based upon the desired functionality and/or appearance of the attachment interface portion 110 and the ability of each attachment slot 115 to allow at least a portion of an accessory attachment element 121 to pass therethrough without undue or excess movement or play within each attachment slot 115.

The attachment slots 115 are arranged in a repeating or semi-repeating series or sequence of spaced apart, repeating patterns. In various exemplary embodiments, the attachment slots 115 are arranged in a column 116. The longitudinal axis, $A_L$, of the column 116 is parallel to the longitudinal axis, $A_L$, of each accessory attachment element 121.

It should be appreciated that two or more adjacent attachment slots 115 may comprise a row and two or more adjacent attachment slots 115 may comprise a column 116. Thus, it should be appreciated that the number of attachment slots 115 formed in the attachment interface portion 110 is a design choice based upon the desired size and/or functionality of the attachment interface portion 110.

By arranging the attachment slots 115 in a repeating or semi-repeating series or sequence, tunnel segments are created between adjacent attachment slots 115 (typically along a longitudinal axis, $A_L$, of a column 116).

One or more locking slots 118 are also formed within the column 116 of attachment slots 115. A width of each locking slot 118 generally corresponds to a width of the accessory attachment element 121 between opposing attachment element notches 126 of a given accessory attachment element 121. The locking slot 118 is typically formed proximate a location where the attachment element notches 126 will be located when the accessory attachment element 121 is folded over the attachment interface panel 105.

In certain exemplary embodiments, a locking aperture 119 is also formed proximate each locking slot 118. Each locking aperture 119 is formed proximate a location where each attachment locking aperture 128 will rest when the attachment element notches 126 are positioned within the locking slots 118. Alignment of the locking aperture 119 with the attachment locking aperture 128 allows an additional fastening element to be positioned through the aligned attachment locking aperture 128 and locking aperture 119 to further secure the terminating portion 125 of the accessory attachment element 121 to the attachment interface portion 110.

In certain exemplary embodiments, the attachment interface panel 105 is formed of a portion of a fabric-type or other material, such as, for example, chlorosulfonated polyethylene (CSPE) synthetic rubber (CSM). In certain exemplary embodiments, the attachment interface panel 105 is formed of a portion of Hypalon fabric. However, the present disclosure is not so limited. For example, in certain exemplary embodiments, the attachment interface panel 105 may be formed of a rigid material, a semi-rigid material, or a substantially flexible material.

In various exemplary, non-limiting embodiments, all or portions of the attachment interface panel 105 may be made of any fabric or other material, such as, for example, interwoven fabrics, canvas, acrylics, sheet fabrics, films, nylon, spandex, vinyl, Polyvinyl Chloride (PVC), neoprene, or the like. Alternatively, all or portions of the attachment interface panel 105 may be formed from multiple, similar or dissimilar materials. In various exemplary, non-limiting embodiments, the attachment interface panel 105 may be water-resistant or may include a cushion material.

It should be appreciated that the terms fabric and material are to be given their broadest meanings and that the particular fabric(s) or material(s) used to form the attachment interface panel 105 is a design choice based on the desired appearance and/or functionality of the attachment interface panel 105. In general, the material used to form the attachment interface panel 105 is selected for its ability to allow the accessory attachment element(s) 121 to be appropriately interwoven between the attachment slots 115 of the attachment interface portion 110.

While the attachment interface portion 110 is illustrated as comprising a somewhat rectangular portion of material, it should be appreciated that the overall size and shape of the attachment interface portion 110 is a design choice based upon the desired appearance and/or functionality of the attachment interface panel 105 and/or the size and/or shape of the accessory 140 to which the attachment interface panel 105 is to be attached or coupled.

During assembly of the attachment interface panel 105, the terminal ends 123 of the accessory attachment elements 121 are folded over, proximate the junction between the attachment interface portion 110 and the accessory attachment portion 120 toward the rear side 109 of the attachment interface panel 105. The terminal end 123 of each accessory attachment element 121 is then urged through the longitudinally aligned attachment slot 115 formed proximate the junction between the attachment interface portion 110 the accessory attachment portion 120, from the rear side 109, to extend, through the attachment slot 115, from the front side 107. The terminal end 123, terminal portion, and at least a portion of the extension portion 122 is urged through the respective attachment slot 115, such that at least a portion of the rear side 109 of the accessory attachment element 121 is adjacent a rear side 109 of the attachment interface portion 110, as illustrated most clearly in FIGS. 2-4.

When each accessory attachment element 121 is appropriately positioned through an attachment slot 115, each of the accessory attachment elements 121 is at least partially attached or coupled to a portion of the attachment interface portion 110 to maintain the accessory attachment element 121 in the folded or fold-over position. In certain exemplary embodiments, one or more stitches 117 are positioned proximate the junction between the attachment interface portion 110 and the accessory attachment portion 120 to stitch 117 at least a portion of the extension portion 122 of the accessory attachment element 121 to the attachment interface portion 110. Alternatively, a portion of the accessory attachment elements 121 may be attached or coupled to a portion of the attachment interface portion 110 via adhesive, heat welding, etc.

By providing the accessory attachment elements 121 in the folded or fold-over position, and extending through an attachment slot 115, the accessory attachment elements 121 are maintained in a position above the front side 107 of the attachment interface portion 110. Thus, the accessory attachment elements 121 are positioned primarily above and within the attachment interface portion 110 and do not naturally extend above the attachment interface portion 110.

Figure 2:
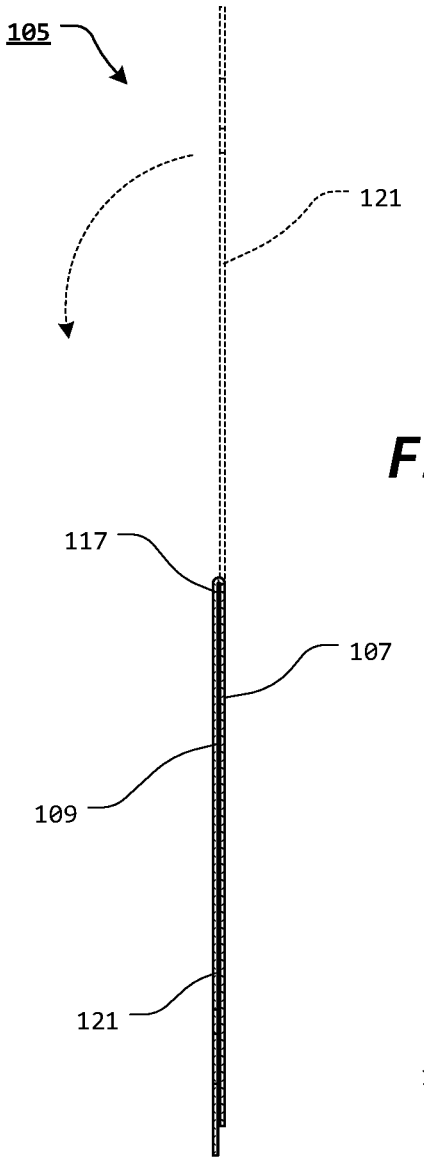
FIG. 2 illustrates a side view of certain exemplary components of an exemplary embodiment of an integral accessory attachment interface, wherein said accessory attachment element is folded to the rear side of the attachment interface portion, according to the present disclosure.
Figure 3:
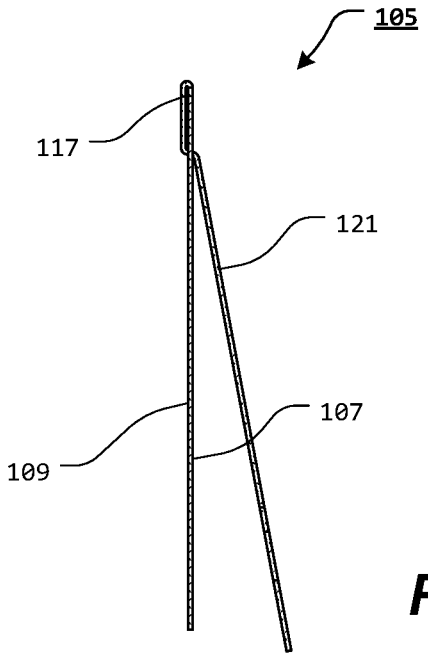
FIG. 3 illustrates a side view of certain exemplary components of an exemplary embodiment of an integral accessory attachment interface, wherein said accessory attachment element is folded to the rear side of the attachment interface portion and at least a terminating portion of the accessory attachment element is urged through an attachment slot of the attachment interface portion, according to the present disclosure.
Figure 4:
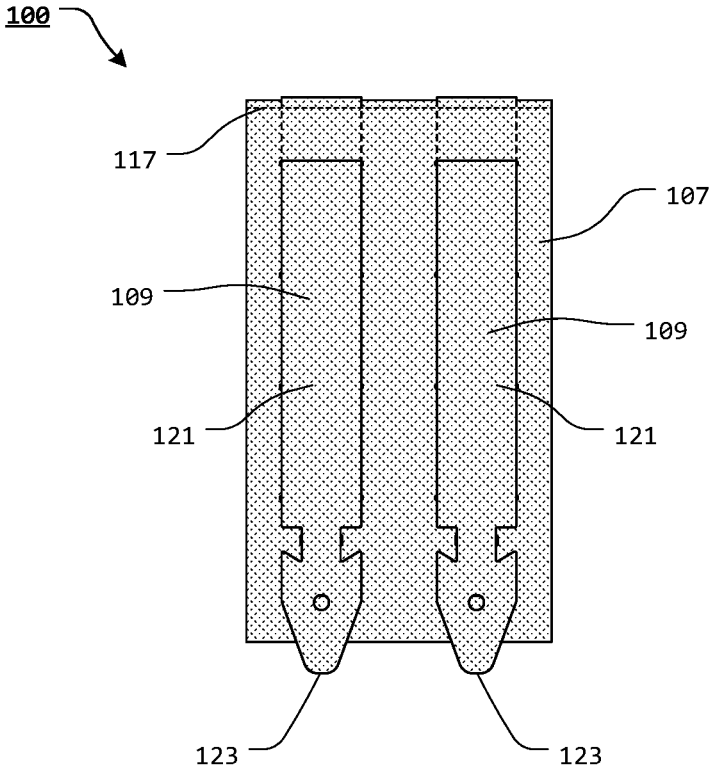
FIG. 4 illustrates a front view of certain exemplary components of an exemplary embodiment of an integral accessory attachment interface, wherein said accessory attachment elements are folded to the rear side of the attachment interface portion and at least a terminating portion of the accessory attachment elements are urged through respective attachment slots of the attachment interface portion, according to the present disclosure.
Figure 5:
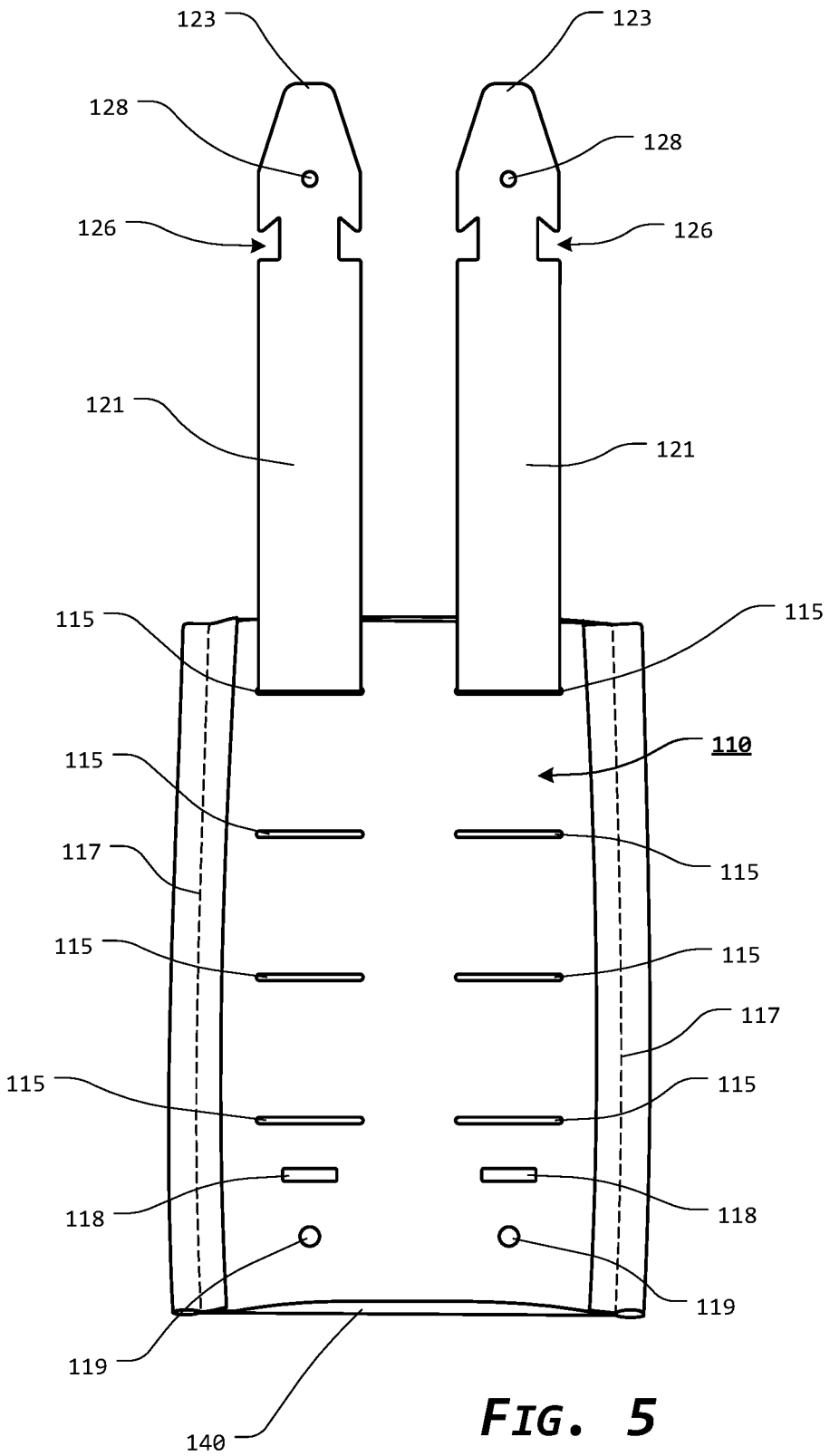
FIG. 5 illustrates a front, perspective view of certain exemplary components of an exemplary embodiment of an integral accessory attachment interface, wherein said integral accessory attachment interface is attached or coupled to an exemplary accessory, according to the present disclosure.
Figure 6:
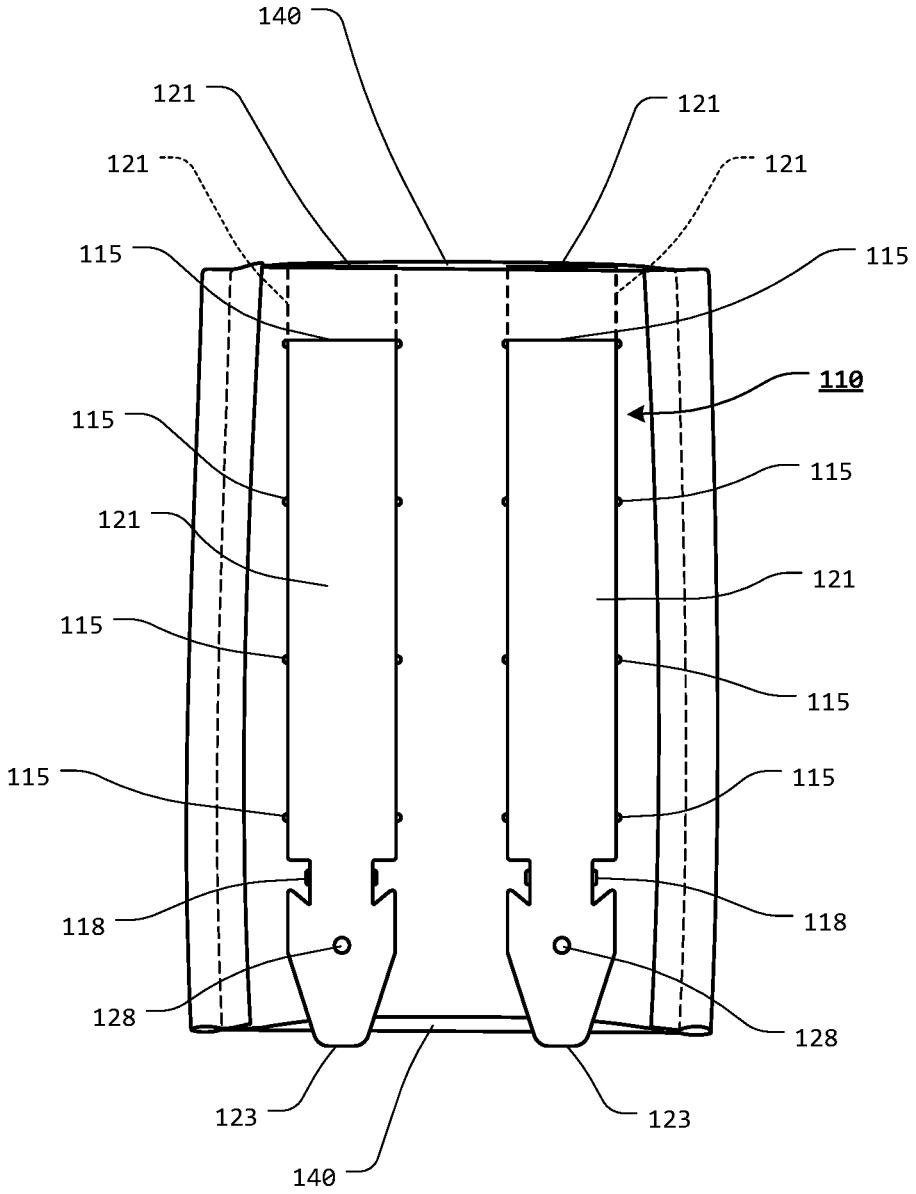
FIG. 6 illustrates a front view of certain exemplary components of an exemplary embodiment of an integral accessory attachment interface, wherein said integral accessory attachment interface is attached or coupled to an exemplary accessory, according to the present disclosure.
Figure 7:
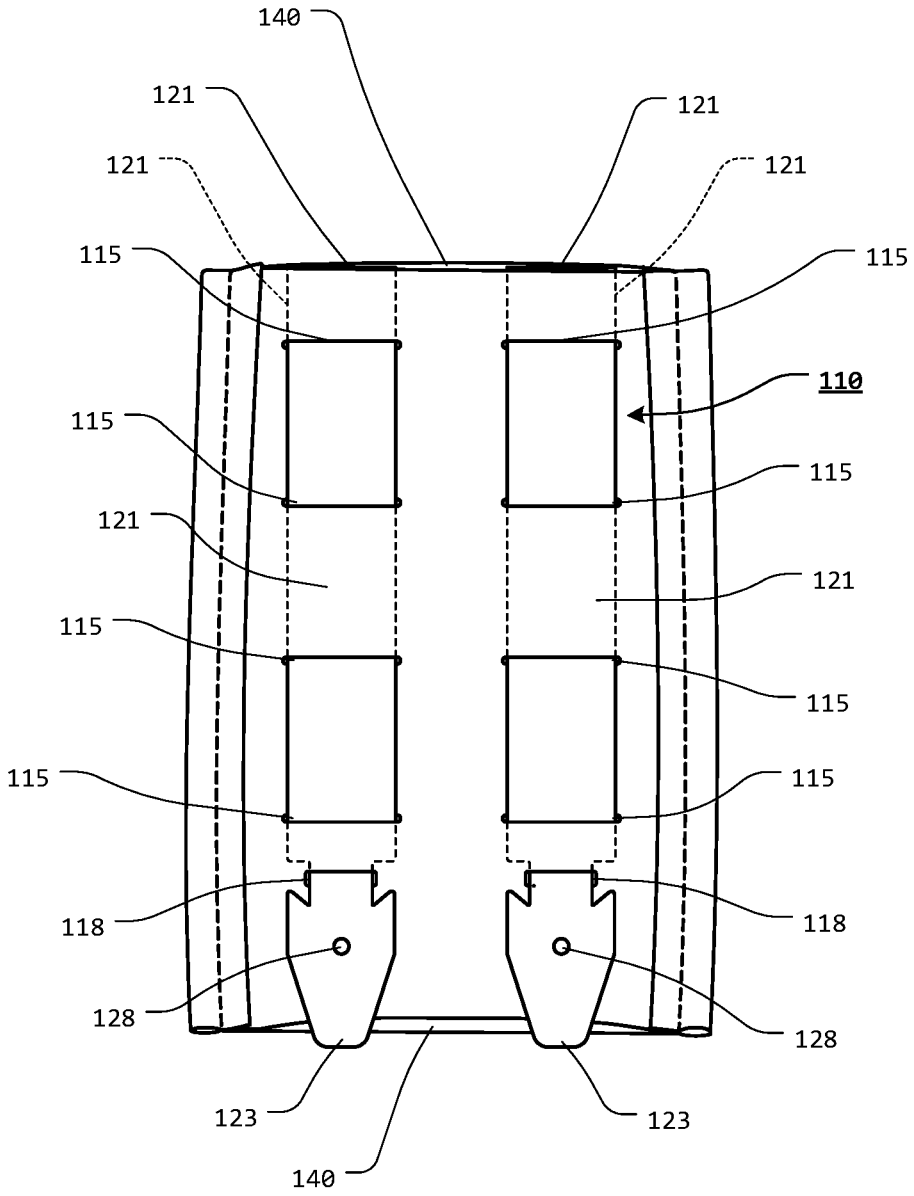
FIG. 7 illustrates a front, perspective view of certain exemplary components of an exemplary embodiment of an integral accessory attachment interface, wherein said integral accessory attachment interface is attached or coupled to an exemplary accessory, according to the present disclosure.

When the attachment interface panel 105 is assembled as illustrated in FIGS. 2-4, the attachment interface panel 105 may be at least partially attached or coupled to a portion of the accessory 140. As illustrated most clearly in FIGS. 5-7, the attachment interface portion 110 may optionally be attached or coupled to a portion of the accessory 140 by attachment elements, such as stitching 117 proximate a perimeter of the attachment interface portion 110 and a perimeter of the portion of the accessory 140.

In certain exemplary embodiments, the stitching 117 utilized to position the accessory attachment elements 121 relative to the attachment interface portion 110 is the stitching 117 utilized to attach or couple the attachment interface portion 110 to the accessory 140.

In certain exemplary embodiments, the attachment elements comprise stitching 117. Alternatively, the attachment interface portion 110 may be attached or coupled to the accessory 140 via adhesive bonding, welding, screws, rivets, pins, mating hook and loop portions, snap or releasable fasteners, or other known or later developed means or methods for permanently or releasably attaching or coupling the attachment interface portion 110 to the accessory 140.

In addition to the variability of size and shape of the attachment interface portion 110, the orientation of the attachment interface portion 110, relative to the accessory 140, is also a design choice. Thus, while the attachment interface portion 110 is illustrated as being attached or coupled to the accessory 140, such that the columns 116 of attachment slots 115 are substantially parallel to the longitudinal axis, $A_L$, along the length, of the accessory 140, it should be appreciated that this is merely exemplary and the attachment interface portion 110 may be attached at any desired angular or rotational orientation relative to the accessory 140.

The portions of material of the attachment interface portion 110 between adjacent attachment slots 115 form tunnel segments. If the attachment interface portion 110 is attached to an accessory 140, the tunnel segments are formed between the attachment interface portion 110 and the surface of the accessory 140. The tunnel segments provide areas for securing the accessory attachment element(s) 121 to the attachment interface portion 110. In this manner, an accessory attachment element 121 may be interwoven between the aligned tunnel segments to removably attach the accessory 140 to a portion of MOLLE webbing, slots, or other features of an article of clothing, a vest, a plate carrier, a backpack, a pack, a platform, and other carrier or device to which the accessory 140 is to be attached.

A more detailed explanation of the instructions regarding how to interweave the accessory attachment element 121 between the attachment slots 115 and attachment elements of the device to which the accessory 140 is to be attached or coupled is not provided herein because accessories incorporating the attachment interface panel 105 of the present disclosure are generally attached or coupled to the device to which the accessory 140 is to be attached or coupled in a manner similar to the manner in which accessories are attached or coupled to a portion of MOLLE webbing. Therefore, it is believed that the level of description provided herein is sufficient to enable one of ordinary skill in the art to understand and practice the systems, methods, and apparatuses, as described.

Figure 8:
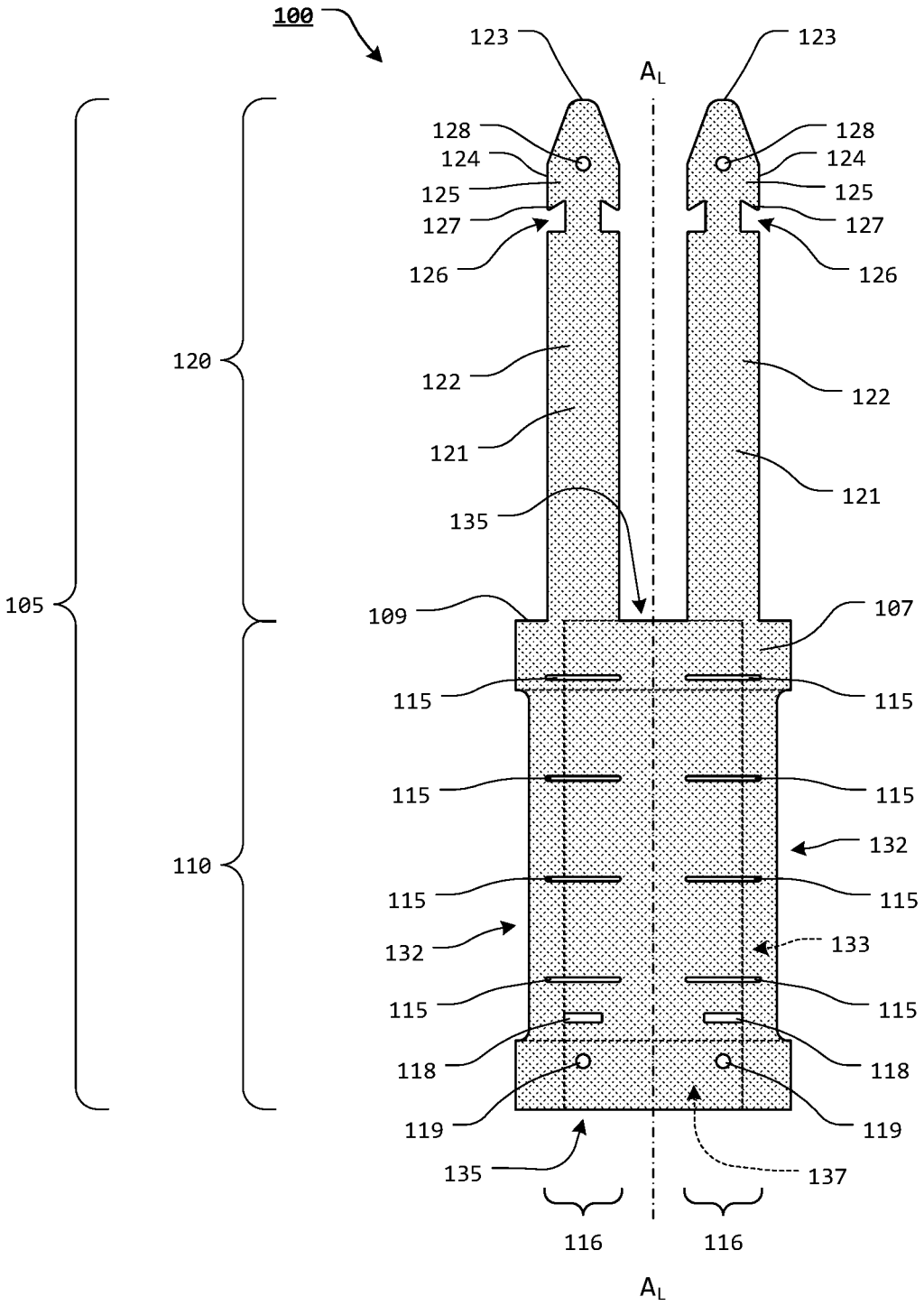
FIG. 8 illustrates a front view of certain exemplary components of an exemplary embodiment of an integral accessory attachment interface, according to the present disclosure.

As illustrated in FIG. 8, vertical tunnel notches 132 may optionally be formed in opposing sides or terminal ends 123 of the attachment interface portion 110. For example, a right vertical tunnel notch 132 may optionally be formed proximate a right side of the attachment interface portion 110 and a left vertical tunnel notch 132 may optionally be formed proximate a left side of the attachment interface portion 110. When the attachment interface portion 110 is attached or coupled to an accessory 140, a vertical tunnel 133 is formed between the right vertical tunnel notch 132 and the left vertical tunnel notch 132, between a portion of the rear side 109 of the attachment interface portion 110 and the accessory 140. In certain exemplary embodiments, at least a portion of the vertical tunnel 133 is formed between a rear surface of the attachment interface portion 110 and an outer surface of the accessory 140.

By incorporating the vertical tunnel notches 132, and attaching or coupling the attachment interface portion 110 to the accessory 140 in the areas of the attachment interface portion 110 that extend beyond the vertical tunnel notches 132, the vertical tunnel notches 132 and vertical tunnel 133 may be utilized to thread a belt 150 between at least a portion of the attachment interface portion 110 and the accessory 140 to attach the accessory 140 to the belt 150.

Additionally, when the attachment interface portion 110 is attached or coupled to an accessory 140, a horizontal tunnel 137 may optionally be formed between an upper portion of the attachment interface portion 110 and a lower portion of the attachment interface portion 110, between a portion of the rear side 109 of the attachment interface portion 110 and the accessory 140. A horizontal tunnel entry aperture 135 is formed or created under at least a portion of the attachment interface panel 105. In certain exemplary embodiments, at least a portion of the horizontal tunnel 137 is formed between a rear surface of the attachment interface portion 110 and an outer surface of the accessory 140.

By attaching or coupling the attachment interface portion 110 to the accessory 140 in the areas of the attachment interface portion 110 to create the horizontal tunnel 137, the horizontal tunnel 137 may be utilized to thread a belt 150 between at least a portion of the attachment interface portion 110 and the accessory 140 to attach the accessory 140 to the belt 150.

Figure 9:
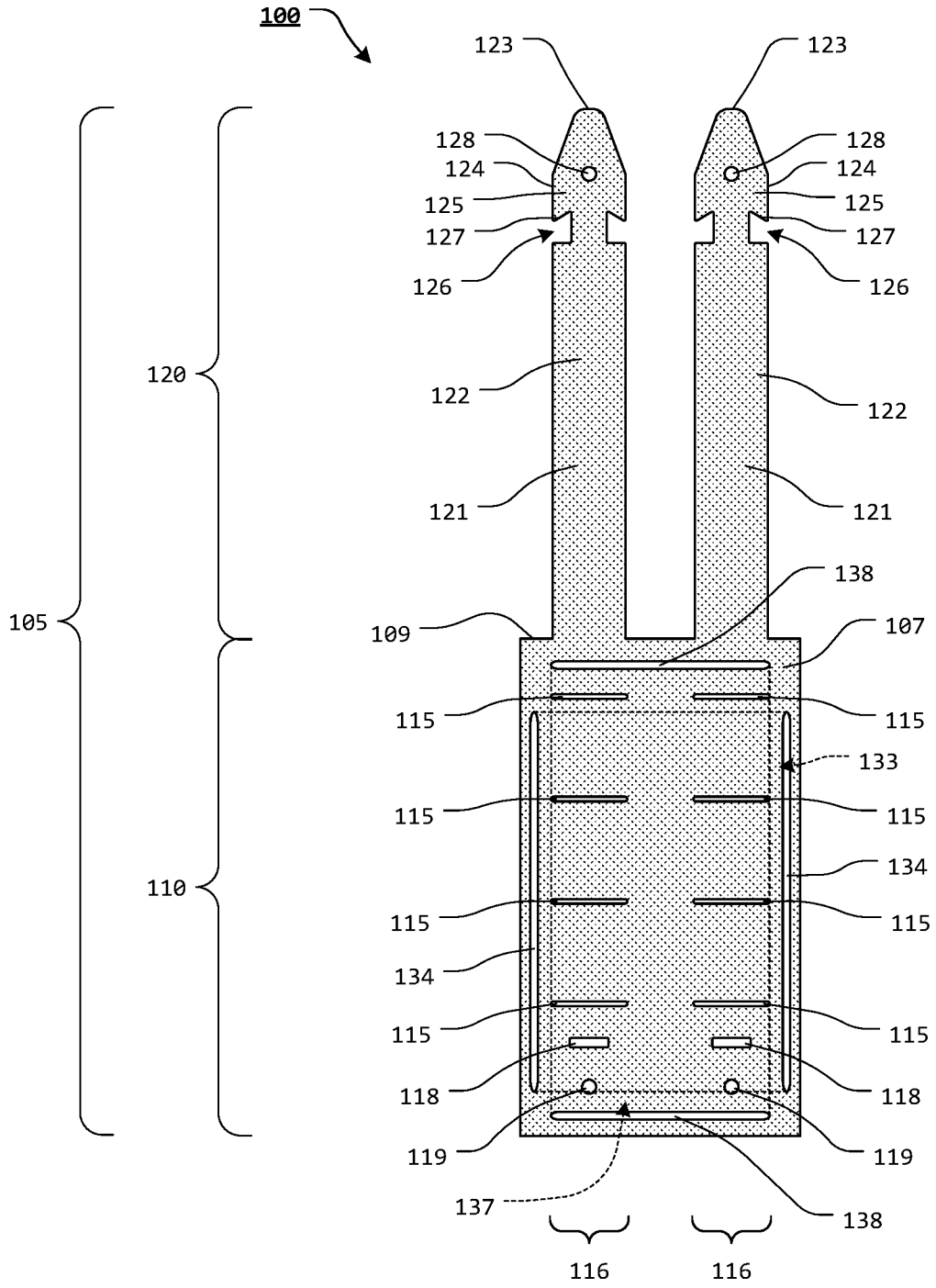
FIG. 9 illustrates a front view of certain exemplary components of an exemplary embodiment of an integral accessory attachment interface, according to the present disclosure.

As illustrated in FIG. 9, vertical tunnel slots 134 may optionally be formed in opposing sides of the attachment interface portion 110, proximate opposing terminal edges of the attachment interface portion 110. For example, a right vertical tunnel slot 134 may optionally be formed proximate a right side of the attachment interface portion 110 and a left vertical tunnel slot 134 may optionally be formed proximate a left side of the attachment interface portion 110. When the attachment interface portion 110 is attached or coupled to an accessory 140, a vertical tunnel 133 is formed between the right vertical tunnel slot 134 and the left vertical tunnel slot 134, between a portion of the rear side 109 of the attachment interface portion 110 and the accessory 140. In certain exemplary embodiments, at least a portion of the vertical tunnel 133 is formed between a rear surface of the attachment interface portion 110 and an outer surface of the accessory 140.

By incorporating the vertical tunnel slots 134, the vertical tunnel slots 134 and vertical tunnel 133 may be utilized to thread a belt 150 between at least a portion of the attachment interface portion 110 and the accessory 140 to attach the accessory 140 to the belt 150.

Alternatively, or additionally, horizontal tunnel slots 138 may optionally be formed in opposing sides of the attachment interface portion 110, proximate opposing upper and lower terminal edges of the attachment interface portion 110. For example, an upper horizontal tunnel slot 138 may optionally be formed proximate an upper side of the attachment interface portion 110 and a lower horizontal tunnel slot 138 may optionally be formed proximate a lower side of the attachment interface portion 110. When the attachment interface portion 110 is attached or coupled to an accessory 140, a horizontal tunnel 137 is formed between the upper horizontal tunnel slot 138 and the lower horizontal tunnel slot 138, between a portion of the rear side 109 of the attachment interface portion 110 and the accessory 140. In certain exemplary embodiments, at least a portion of the horizontal tunnel 137 is formed between a rear surface of the attachment interface portion 110 and an outer surface of the accessory 140.

By incorporating the horizontal tunnel slots 138, the horizontal tunnel slots 138 and horizontal tunnel 137 may be utilized to thread a belt 150 between at least a portion of the attachment interface portion 110 and the accessory 140 to attach the accessory 140 to the belt 150.

In certain exemplary, nonlimiting embodiments, a longitudinal axis, $A_L$, of the vertical tunnel 133 and a longitudinal axis, $A_L$, of the horizontal tunnel 137 are offset by approximately 90°. Alternatively, a longitudinal axis, $A_L$, of the vertical tunnel 133 and a longitudinal axis, $A_L$, of the horizontal tunnel 137 are offset by an obtuse or an acute angle.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An integral accessory attachment interface, comprising:

an attachment interface portion, wherein a plurality of attachment slots are provided through at least a portion of said attachment interface portion, wherein at least some of said attachment slots are longitudinally aligned, wherein at least one locking slot is provided through at least a portion of said attachment interface portion, and wherein said at least one locking slot is longitudinally aligned with said longitudinally aligned attachment slots; and one or more accessory attachment elements extending as an integral extension of a portion of said attachment interface portion, wherein attachment element notches are defined by recesses formed in opposing side portions of each of said accessory attachment elements, between said attachment interface portion and a terminating portion of each of said accessory attachment elements, wherein a width of each of said accessory attachment elements between said attachment element notches generally corresponds to a width of each said at least one locking slot such that at least a portion of each said accessory attachment element between said attachment element notches is positionable within at least a portion of said at least one locking slot, wherein at least a portion of each of said accessory attachment elements is folded over, proximate a junction between said attachment interface portion and said accessory attachment element, toward a rear side of said attachment interface portion, and wherein at least a portion of each of said accessory attachment elements is urged through an aligned attachment slot formed proximate said junction between said attachment interface portion and said accessory attachment element, to extend through said attachment slot, from a front side of said attachment interface portion.

2. The integral accessory attachment interface of claim 1, wherein said integral accessory attachment interface is formed of a single, integral portion of material.

3. The integral accessory attachment interface of claim 1, wherein said integral accessory attachment interface is formed of a unitary body or a one-piece article.

4. The integral accessory attachment interface of claim 1, wherein a width of said at least one locking slot is less than a width of each of said attachment slots.

5. The integral accessory attachment interface of claim 1, wherein each of said accessory attachment elements is at least partially attached or coupled to a portion of said attachment interface portion, via stitching, to assist in maintaining said accessory attachment element through said aligned attachment slot.

6. The integral accessory attachment interface of claim 1, wherein one or more vertical tunnel slots are formed through at least a portion of said attachment interface portion.

7. The integral accessory attachment interface of claim 1, wherein one or more horizontal tunnel slots are formed through at least a portion of said attachment interface portion.

8. An integral accessory attachment interface, comprising:

an attachment interface portion, wherein a plurality of attachment slots are provided through at least a portion of said attachment interface portion, wherein at least some of said attachment slots are aligned in a column, wherein at least one locking slot is provided through at least a portion of said attachment interface portion, and wherein said at least one locking slot is aligned with said column of said attachment slots; and at least one accessory attachment element extending as an integral extension of a portion of said attachment interface portion, wherein attachment element notches are defined in opposing side portions of said at least one accessory attachment element, between said attachment interface portion and a terminating portion of said at least one accessory attachment element, wherein a width of said at least one accessory attachment element between said attachment element notches allows at least a portion of each said at least one accessory attachment element between said attachment element notches to be positionable within at least a portion of said at least one locking slot, wherein at least a portion of said at least one accessory attachment element is folded over, proximate a junction between said attachment interface portion and said at least one accessory attachment element, toward a rear side of said attachment interface portion, wherein at least a portion of said at least one accessory attachment element is urged through an aligned attachment slot formed proximate said junction between said attachment interface portion and said at least one accessory attachment element, to extend through said attachment slot, from a front side of said attachment interface portion.

9. The integral accessory attachment interface of claim 8, wherein said integral accessory attachment interface is formed of a single, integral portion of material.

10. The integral accessory attachment interface of claim 8, wherein said integral accessory attachment interface is formed of a one-piece article.

11. The integral accessory attachment interface of claim 8, wherein said integral accessory attachment interface is formed as a unitary body.

12. The integral accessory attachment interface of claim 8, wherein each of said at least one accessory attachment elements is at least partially attached or coupled to a portion of said attachment interface portion, via stitching, to assist in maintaining said at least one accessory attachment element through said aligned attachment slot.

13. The integral accessory attachment interface of claim 8, wherein one or more vertical tunnel slots are formed through at least a portion of said attachment interface portion.

14. The integral accessory attachment interface of claim 8, wherein one or more horizontal tunnel slots are formed through at least a portion of said attachment interface portion.

15. An integral accessory attachment interface, comprising:

an attachment interface panel having an attachment interface portion and at least one accessory attachment element, wherein a plurality of aligned attachment slots are provided through at least a portion of said attachment interface portion, wherein at least one locking slot is provided through at least a portion of said attachment interface portion, and wherein said at least one locking slot is aligned with said aligned attachment slots, and wherein said at least one accessory attachment element extends as an integral extension of a portion of said attachment interface portion, wherein attachment element notches are defined in opposing side portions of said at least one accessory attachment element, between said attachment interface portion and a terminating portion of said at least one accessory attachment element, wherein at least a portion of said accessory attachment element is urged through an aligned attachment slot formed proximate said junction between said attachment interface portion and said accessory attachment element, to extend through said attachment slot, from a front side of said attachment interface portion, and wherein a width of said at least one accessory attachment element between said attachment element notches allows at least a portion of each said at least one accessory attachment element between said attachment element notches to be positionable within at least a portion of said at least one locking slot.

16. The integral accessory attachment interface of claim 15, wherein said integral accessory attachment interface is formed of a single, integral portion of material.

17. The integral accessory attachment interface of claim 15, wherein said integral accessory attachment interface is formed of a one-piece article.

18. The integral accessory attachment interface of claim 15, wherein said integral accessory attachment interface is formed as a unitary body.

19. The integral accessory attachment interface of claim 15, wherein one or more vertical tunnel slots are formed through at least a portion of said attachment interface portion.

20. The integral accessory attachment interface of claim 15, wherein one or more horizontal tunnel slots are formed through at least a portion of said attachment interface portion.

* * * * *